United States Patent [19]

Straub

[11] 4,114,388

[45] Sep. 19, 1978

[54] PILE PROTECTION DEVICE

[76] Inventor: Erik K. Straub, Carroll Rd., Monkton, Md. 21111

[21] Appl. No.: 789,431

[22] Filed: Apr. 20, 1977

[51] Int. Cl.[2] ..... E02D 5/60

[52] U.S. Cl. ..... 405/216; 405/217

[58] Field of Search ..... 61/1 R, 54, 102

[56] References Cited

U.S. PATENT DOCUMENTS

| | | | |
|---|---|---|---|
| 3,338,058 | 8/1967 | Young | 61/54 |
| 3,370,432 | 2/1968 | Butler et al. | 61/54 |
| 3,807,179 | 4/1974 | Stone | 61/1 R |
| 3,831,385 | 8/1974 | Hudson et al. | 61/102 |
| 4,019,301 | 4/1977 | Fox | 61/54 X |
| 4,023,374 | 5/1977 | Colbert et al. | 61/54 |

*Primary Examiner*—Mervin Stein
*Assistant Examiner*—David H. Corbin
*Attorney, Agent, or Firm*—Oblon, Fisher, Spivak, McClelland & Maier

[57] ABSTRACT

A device for protecting a pile from ice formations collecting on and subsequently extracting the pile as a result of a variation of tide level including a tapered guard member secured to the pile. The guard member is firmly secured to the pile by interconnecting stiffening members, horizontal stiffening rings, vertical fin members and compression rings which also serve to prevent deformation of the guard member taper as a result of interaction with the ice formations. The guard member comprises two sections connected by vertically extending tongue and groove joints.

7 Claims, 7 Drawing Figures

PILE PROTECTION DEVICE

BACKGROUND OF THE INVENTION

This invention relates generally to a pile protection guard for preventing ice formations from collecting on and subsequently extracting a pile as a result of a variation of tide level.

Severe damage may be caused to timber or tapered section pilings in freezing weather in tidal waters, the reason being that the water freezes and establishes ice formations around the pilings during high tides. As the tide falls or ebbs the ice mass that has formed around the pile is lowered as a result of the falling water level. At low tide the ice freezes in the void area created when the ice mass slides down the tapered pile section, and subsequently, when the tide rises, this ice interracts with the piling to lift and eventually extract the base of the piling from the hole or bore into which it had been previously driven at the bottom of the water body. During the time periods of constant freezing conditions, the cyclical action of the tide will actually extract the piling completely from the bottom of the water body.

To counteract the adverse effects of ice formation on pilings, many proposed devices have been adapted to pilings with varying degrees of success. However, none of these devices have proven to be wholly successful as well as being of a simple and economical construction.

U.S. Pat. No. 3,170,299 to Clark discloses a device in the form of a sheath situated around a pile in the shape of a cylinder, extending above the high water line and below the point at which ice freezes. An insulating material is carried in a ring at the upper portion of the sheath so that the water contained inside the sheath retains more heat and therefore prevents freezing.

U.S. Pat. No. 3,180,099 to Mikolajczyk et al. discloses a pile protector in the form of a sheath positioned around a pile and containing an inner lining of material having a low friction coefficient. The sheath extends below the point at which ice forms and also above the high water mark. A spring is placed between the top of the sheath and the bottom of the dock and thus, when ice is frozen around the sheath and the tide is rising, the sheath moves upwardly and compresses the spring. Moreover, when the tide lowers, the spring returns the sheath to its original position and therefore, the sheath moves up and down around the pile preventing any upward force on the pile itself.

SUMMARY OF THE INVENTION

It is an object of the invention to provide an effective and economical pile protection device for preventing ice formations from collecting on and extracting a pile.

Another object of the invention is to provide a pile protection device which is easily and effectively secured to a pile and capable of resisting deformation due to interaction with ice formations.

According to the present invention, the foregoing and other objects are attained by providing a pile with a guard member concentrically mounted to and axially extending along the pile such that the guard member is tapered in such a manner that the diameter of the guard member decreases in an upward direction to allow for a vertical displacement of an ice formation relative to the guard member.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof and wherein.

DESCRIPTION OF THE PREFERRED EMBODIMENT

Figure 1:
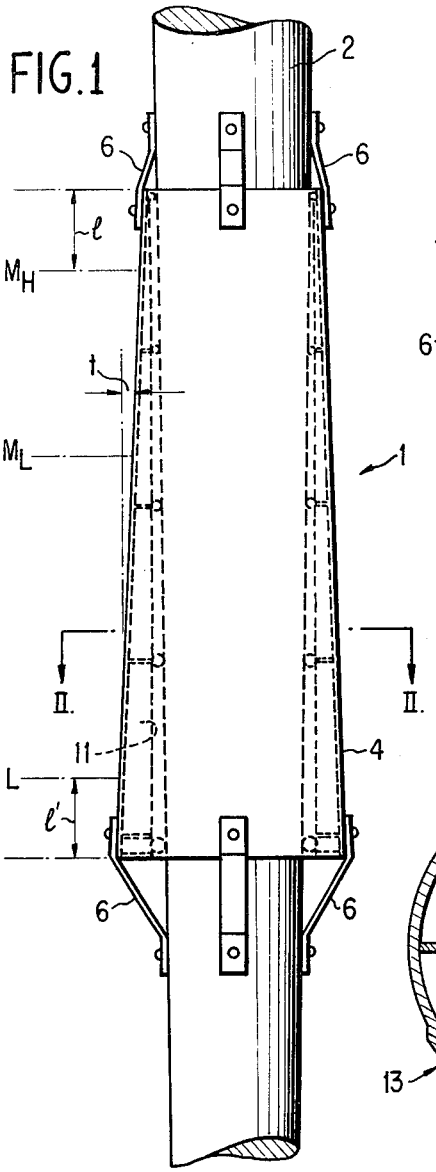
FIG. 1 is a side elevational view of the pile protection device embodying the invention.
Figure 2:
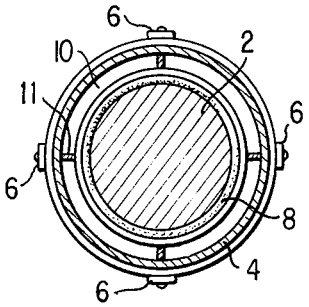
FIG. 2 is a cross-sectional view taken along line II—II of FIG. 1.
Figure 3:
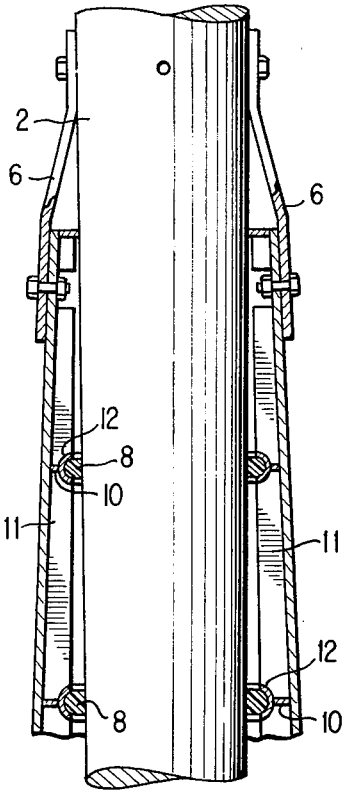
FIG. 3 is a cross-sectional view taken along the upper portion of FIG. 1.

Referring now to FIG. 1, there is shown a pile protection device 1 which is suitably mounted to a pile 2 and includes fastening straps 6 located on the upper and lower portions of the pile protection device 1 to secure the upper and lower extremities of pile protection device 1 to pile 2. Pile protection device 1 is concentrically mounted to and axially extends along pile 2 and is provided with taper t such that the diameter of pile protecton device 1 decreases in an upward direction.

Pile protection device 1 can be made in any length insofar as the length is determined by the tidal range in a given geographic area and by the freezing conditions that could be anticipated or taken from historical records. The length of pile protection device 1 is such that the top of the pile protection device is located above mean high water line $M_H$ and, more importantly, the bottom of pile protection device 1 is below the bottom of the ice denoted as reference letter L. The thickness at low tide of the ice formation is represented in FIG. 1 as being that distance between the mean low water line $M_L$ and the bottom of the ice L. Therefore, the top of pile protection device 1 is provided at a distane $l$ above mean high water line $M_H$ while the bottom of the pile protection device is displaced at an appropriate distance $l'$ below the bottom of the ice L. The pile protection device is preferably made with a taper $t$ of $\frac{1}{2}$ inch/foot from top to bottom.

It should be particularly noted that pile protection device 1 can be made in various diameters to suit various size pilings. However, most piling damage due to ice formations is caused to residential or small commercial installations such as yacht clubs, marinas, etc. It is thus anticipated that the normal maximum top diameter of the piling protection device would be approximately 12 to 14 inches.

As shown in FIGS. 2–5, pile protection device 1 includes vertically extending first and second sections 4*a* and 4*b* respectively, which are connected at the interior thereof with side wall stiffening rings 10, vertical fins 11 and horizontal stiffening rings 12 which serve to firmly secure guard sections 4*a* and 4*b* to pile 2. Compressible rings 8 are also displaced between horizontal stiffening rings 12 and pile 2 and may include closed cell foam of a size which varies to provide for a firm fitting of guard sections 4*a* and 4*b* to pile 2.

Horizontal stiffening rings 12 are spaced depending upon the overall length and thickness of guard sections 4*a* and 4*b* as well as the anticipated thickness of the ice formations. More importantly, horizontal stiffening rings 12 are spaced so as to not allow guard sections 4*a* and 4*b* to deform from taper t under pressure from the ice formation.

Side wall stiffening rings 10 are displaced at various points based upon the overall length and thickness of guard sections 4*a* and 4*b*, the spacings of horizontal stiffening rings 12 and the anticipated thickness of the ice formations. Horizontal stiffening rings 12 are fitted with compressible rings 8 of closed cell foam or similar material to allow guard sections 4*a* and 4*b* to fit firmly against pile 2. Vertical fins 11 are also provided to connect with the interior portion of guard sections 4*a* and 4*b* as well as interconnecting side wall stiffening rings 10 and horizontal stiffening rings 12 to one another to form a supportive grid system within guard sections 4*a* and 4*b*. The specific dimensions of side wall stiffening rings 10, vertical fins 11 and horizontal stiffening rings 12 may be varied according to the desired thickness of guard sections 4*a* and 4*b*.

Guard sections 4*a* and 4*b* are composed of a plastic or polyvinyl chloride material insofar as most tidal water is salty or brackish and the resulting corrosive effect of the water would therefore not harm guard sections 4*a* and 4*b*. Identical dimensioning of each of guard sections 4*a* and 4*b* is provided for, thus allowing for the use of only a single mold during guard section production. Moreover, the plastic or polyvinyl chloride guard sections 4*a* and 4*b* would resist deterioration, thus indefinitely presenting a smooth surface to the ice formation. It would also be desirable to utilize a plastic or a polyvinyl chloride having a self-lubricating characteristic which would be important insofar as presenting minimal frictional engagement with the ice formation. Fastening straps 6 located at the upper and lower portion of guard sections 4*a* and 4*b* can also be made of a plastic or polyvinyl chloride material. Guard sections 4*a* and 4*b* could also be fastened to pile 2 using non-corrosive fasteners such as galvanized nails copper nails or galvanized lag screws.

Figure 5:
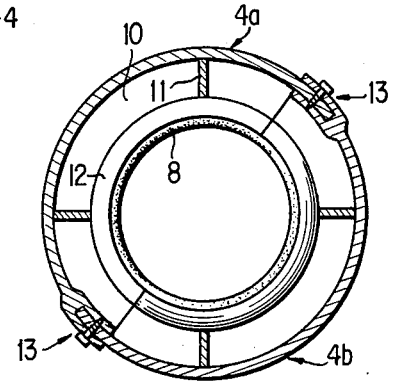
FIG. 5 is an axial cross-sectional view of the pile protection device.
Figure 4:
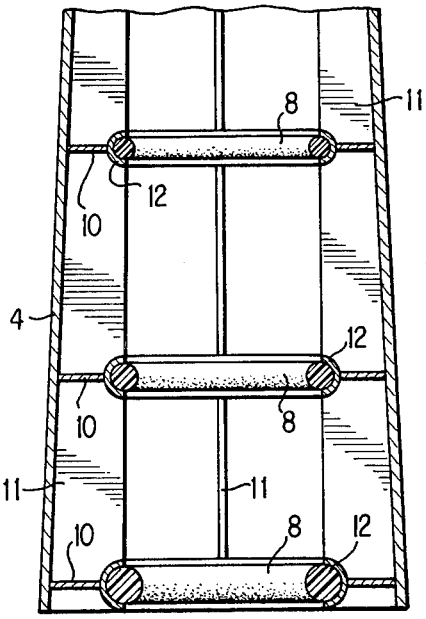
FIG. 4 is a cross-sectional view of the lower portion of the pile protection device only of FIG. 1.
Figure 6A:
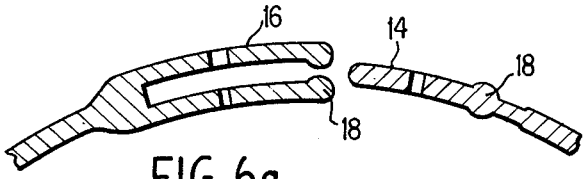
FIGS. 6*a* and 6*b* show alternative embodiments for securing the guard section edges.
Figure 6B:
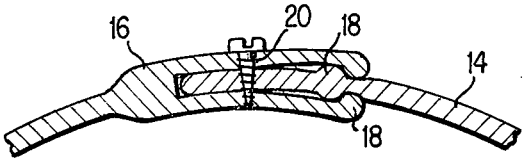

Referring to FIGS. 5 and 6, there is shown a cross-section of guard sections 4*a* and 4*b* and the detailed structure of tongue and groove joints 13. Tongue and groove joints 13 are used to connect guard section 4*a* to guard section 4*b* along the full-length edge portion thereof. The use of tongue and groove joints 13 allows for ease of installation insofar as the two separate guard sections 4*a* and 4*b* can snap together and also allows for a simple and economical manufacture of each of guard sections 4*a* and 4*b*. Tongue and groove joints 13 utilize a separate tongue 14 and groove 16 with a raised bead 18 located on the interengaging surfaces of tongue 14 and groove 16 to thus provide a snap lock type of connection. Thus this type of snap lock connection allows for the fitting of guard sections 4*a* and 4*b* around existing pilings or around pilings with a large butt and smaller tidal zone diameter. Moreover, tongue and groove joints 13 can be further secured by pop riveting or screwing the tongue and groove joint, indicated generally by screw 20, after connection of the tongue and groove.

The attachment of guard sections 4*a* and 4*b* to pile 2 can therefore be recognized as being an economical way to prevent ice formations from acting on a pile. Furthermore, the connection of guard sections 4*a* and 4*b* as illustrated to pile 2 may be advantageously accomplished on existing pilings.

The connection of guard sections 4*a* and 4*b* on existing pilings may therefore have the additional desirable effect of allowing water which is trapped within guard sections 4*a* and 4*b*, between vertical fins 11, horizontal stiffening rings 12 and side wall stiffening rings 10, to provide additional internal support in maintaining taper *t*, even during freezing conditions.

The principle practiced by the present invention is to reverse the taper of the piling by firmly securing a guard section to the piling. Therefore, should an ice formation occur at high tide, when the tide subsequently falls the guard section will force a larger hole in the ice formation around the piling. As the ice formation refreezes at low tide and the tide subsequently rises, the ice formation will be prevented from collecting on and extracting the piling since a smaller effective piling cross-sectional area is provided as the ice formation rises with the tide.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A pile protection device for preventing an ice formation from collecting on and subsequently extracting a pile as a result of variation of tide level, which comprises:

guard means concentrically mounted to and axially extending along said pile, said guard means being tapered such that the diameter of said guard means decreases in an upward direction to thereby allow said ice formation to be vertically displaced relative to said guard means during said tide level variation whereby said ice formation is prevented from extracting said pile during said tide level variation;

means for firmly securing said guard means to said pile; and stiffening means connected to said guard means at a plurality of points along the length of said guard means and located between and interconnecting said guard means and said pile wherein said stiffening means comprises;

a plurality of sidewall stiffening rings disposed adjacent said guard means;

vertical fin members connected to said side wall stiffening rings; and a plurality of horizontal stiffening rings connected to said sidewall stiffening rings operatively associated with said pile to thereby allow said guard means to firmly engage said pile and resist deformation due to interaction with said ice formation and wherein said plurality of horizontal stiffening rings are interconnected by said vertical fin members.

2. The pile protection device of claim 1, which further comprises a compressible ring located between plurality of said horizontal stiffening rings and said pile to thereby provide a firm fitting of said guard means to said pile.

3. The pile protection device of claim 2, wherein said compressible ring comprises a closed cell of foam.

4. The pile protection device of claim 3, wherein said means for firmly securing said guard means comprises;

fastening members for securing said guard means at upper and lower portions thereof to said pile.

5. A pile protection device for preventing an ice formation from collecting on and subsequently extracting a pile as a result of a variation of tide level, which comprises:

guard means concentrically mounted to and axially extending along said pile, said guard means being tapered such that the diameter of said guard means decreases in an upward direction to thereby allow said ice formation to be vertically displaced relative to said guard means during said tide level variation whereby said ice formation is prevented from extracting said pile during said tide level variation;

means for firmly securing said guard means to said pile; and stiffening means connected to said guard means at a plurality of points along the length of said guard means and extending between and interconnecting said guard means and said pile wherein said means for firmly securing said guard means comprises fastening members for securing said guard means at upper and lower portions thereof to said pile and said guard means comprises a vertically extending first and second section and a tongue and groove joint connecting said first and said second section and extending along corresponding interconnecting edge portions of said first and said second sections.

6. The pile protection device of claim 5, wherein said joint further comprises a securing member passing through overlapping portions of said interconnecting edge portions of said first and said second sections.

7. The pile protection device of claim 5, wherein said first and said second sections are formed of a plastic material thereby providing minimal frictional interaction between said ice formation and said guard means.

* * * * *